United States Patent [19]

Sterrenberg

[11] 4,420,262

[45] * Dec. 13, 1983

[54] APPARATUS FOR UTILIZING HAND-HELD POWER DRILL FOR SHAKING PAINT CONTAINERS AND THE LIKE

[76] Inventor: John W. Sterrenberg, 8350 E. McKellips Rd. #146, Scottsdale, Ariz. 85257

[ * ] Notice: The portion of the term of this patent subsequent to Mar. 9, 1999 has been disclaimed.

[21] Appl. No.: 388,262

[22] Filed: Jun. 14, 1982

Related U.S. Application Data

[60] Continuation-in-part of Ser. No. 278,079, Jun. 29, 1981, abandoned, which is a division of Ser. No. 174,172, Jul. 31, 1980, Pat. No. 4,318,622.

[51] Int. Cl.[3] ..... B01F 11/00

[52] U.S. Cl. ..... 366/110; 366/111; 366/130; 366/208

[58] Field of Search ..... 366/110, 111, 114, 129, 366/130, 128, 197, 208, 605, 211, 209; 74/49

[56] References Cited

U.S. PATENT DOCUMENTS

| | | | |
|---|---|---|---|
| 1,328,379 | 1/1920 | Johnson | 366/110 |
| 2,846,201 | 8/1958 | Mermelstein | 74/49 |
| 3,061,280 | 10/1962 | Kraft | 366/110 |
| 3,128,082 | 4/1964 | Cline | 366/110 |
| 3,330,537 | 7/1967 | Wason | 366/114 |

*Primary Examiner*—Robert W. Jenkins

*Attorney, Agent, or Firm*—Cahill, Sutton & Thomas

[57] ABSTRACT

An apparatus for shaking an aerosol spray paint container with a hand-held power drill includes a base member secured to the container by a band or a mounting bracket. The shaking apparatus further includes a first drive shaft rotatably mounted to the base; a second drive shaft is eccentrically mounted to the first drive shaft and is engaged by the rotatable chuck of the drill for causing the base member to rapidly oscillate and vibrate.

17 Claims, 24 Drawing Figures

APPARATUS FOR UTILIZING HAND-HELD POWER DRILL FOR SHAKING PAINT CONTAINERS AND THE LIKE

CROSS-REFERENCE TO RELATED APPLICATIONS

This application is a continuation-in-part of co-pending patent application Ser. No. 278,079, filed June 29, 1981, and entitled "APPARATUS AND METHOD UTILIZING HAND-HELD POWER TOOL FOR SHAKING PAINT CONTAINERS AND THE LIKE", now abandoned, which co-pending application is, in turn, a division of patent application Ser. No. 174,172, filed July 31, 1980, entitled "APPARATUS AND METHOD UTILIZING HAND-HELD POWER TOOL FOR SHAKING PAINT CONTAINERS AND THE LIKE", now U.S. Pat. No. 4,318,622, issued Mar. 9, 1982.

BACKGROUND OF THE INVENTION

1. Field of the Invention

The present invention relates generally to an apparatus for shaking paint containers and the like, and more particularly, to an apparatus for shaking a container utilizing a hand-held power drill.

2. Description of the Prior Art

As is well known, paint must be thoroughly mixed and agitated prior to use in order to ensure that pigment which normally settles out of the liquid carrier is returned into suspension therewith. Apparatus is known in the art for shaking relatively large containers of paint, and such apparatus is typically installed within paint stores for shaking paint containers at the time they are purchased by the customer. Apparatus has also been provided for mixing or stirring paint wherein a shaft having a plurality of blades at its lower end is inserted within an opened paint container and rotated for stirring the paint.

The above described prior art shaking and mixing apparatus may not be utilized in conjunction with aerosol spray paint containers or relatively small sized liquid paint containers. For containers of this type, the user must typically shake the container manually prior to use. However, it is often difficult to return settled paint pigment into suspension by manually shaking the container, particularly when the paint is being used long after it was manufactured and packaged within the container. Accordingly, such containers of paint must typically be manually shaken for relatively long periods of time to achieve proper mixing. Thorough mixing is particularly important with aerosol spray paint containers since the presence of settled pigment may result in the spray nozzle becoming clogged or delivering the spray intermittently.

U.S. Pat. No. 2,846,201 discloses a paint mixing device, one illustrated embodiment of which is adapted to be driven by a portable electric drill. The disclosed paint mixing device includes a frame for supporting a pair of spring elements which in turn support a paint can holding socket. An elastic strap extends from the socket to hold a can of paint therein. The frame also includes a support for securing the drill thereto. A boss containing a ball bearing is secured to the middle portion of the socket. The mixing device further includes a shaft bent to form an offset; one end of the shaft terminates in a ball received by the ball bearing to form a ball and socket joint, while the other end of the shaft is engaged by the chuck of the drill.

The mixing device disclosed in the aforementioned patent is not believed to be well adapted for widespread consumer useage for the purpose of shaking spray paint containers. The paint can holding socket is intended to receive relatively large diameter cans of paint, rather than relatively small diameter, elongated cans of spray paint. In addition, the bulkiness of the frame, associated spring supports, and the can holding socket tend to compel a user of such a device to mount the same at a fixed location, such as upon the corner of a work bench. Thus, the device generally lacks the feature of portability; in addition, the device may not be easily configured into a compact structure for convenient storage and is relatively expensive to manufacture. Furthermore, the elongated bent shaft used to couple the drill to the ball and socket joint is subjected to tremendous stress and leverage forces due to its length. These stress and leverage forces not only increase the likelihood of a fracture of the shaft itself but are also transmitted to the chuck of the portable electric drill and increase the likelihood of damage thereto.

Accordingly, it is an object of the present invention to provide an apparatus for quickly and thoroughly shaking aerosol spray paint containers to ensure that settled paint pigments are put back into suspension immediately before the paint is to be used.

It is another object of the present invention to provide an apparatus for shaking aerosol spray paint containers wherein the apparatus can be utilized in conjunction with a hand-held power drill of the type often found around the home.

It is still another object of the present invention to provide such an apparatus which is highly portable, easily stored within a tool box or a workshop drawer, and which is of relatively inexpensive construction.

It is yet another object of the present invention to provide such an apparatus which minimizes stress and leverage forces transmitted to the chuck of the drill.

It is a further object of the present invention to provide such an apparatus which may easily adjusted to account for drills having different operating speeds to nonetheless produce a desired degree of oscillation of the spray paint container being shaken.

These and other objects of the present invention will become apparent to those skilled in the art as the description thereof proceeds.

SUMMARY OF THE INVENTION

Briefly, and in accordance with one embodiment thereof, the present invention relates to an apparatus utilized in conjunction with a hand-held power drill for shaking a spray paint container, the apparatus including a base member and a securing mechanism for securing the base member to the cylindrical side wall of the spray paint container. A first driveshaft is rotatably mounted to the base member for movement about a first axis of rotation perpendicular to the longitudinal axis of the spray paint container. The first driveshaft has a front face perpendicular to the first axis of rotation, and a second driveshaft extends outwardly from the front face of the first driveshaft by a distance commensurate with the length of the rotatable chuck of the drill. The second driveshaft has a diameter smaller than that of the first driveshaft and has a second axis of rotation offset from the first axis of rotation but extending substantially parallel thereto. The end of the second driveshaft opposite the first driveshaft is engaged by the rotatable chuck of the drill and the user operates the drill to rotate the second driveshaft and thereby vibrate the base member and the spray paint container secured thereto while loosely holding one end of the spray paint container in one of the user's hands.

In one embodiment of the present invention, the base member is secured to the spray paint container by means of a band which encircles the spray paint container and is maintained in a tightened position thereabout. In alternate embodiments of the present invention, the base member is either permanently secured to the spray paint container, as by welds or adhesive bonds, or is slidingly secured within a mounting bracket affixed to the spray paint container.

In one form of the present invention, the base member comprises a housing having a central cylindrical bore within which the first driveshaft is rotatably disposed. The housing and first driveshaft may each be made of plastic material, such as nylon, for providing a relatively inexpensive yet sufficiently sturdy bearing. The second driveshaft may include a threaded end for threadedly engaging one of a plurality of threaded bores formed within the first driveshaft, each being offset from the first axis of rotation by different amounts, to selectively vary the degree of oscillation imparted to the spray paint container at predetermined rotational speeds. In another embodiment of the present invention, the base member is in the form of a plate having a planar front face against which the first driveshaft is retained by a fastener. The fastener extends through a bore formed within the first driveshaft for allowing the same to rotate about the first axis of rotation. The plate and first driveshaft may each be formed of a plastic material, and the fastener may be a conventional metal bolt, thereby allowing the formation of an inexpensive yet sufficiently rugged bearing.

DESCRIPTION OF THE PREFERRED EMBODIMENTS

Figure 1:
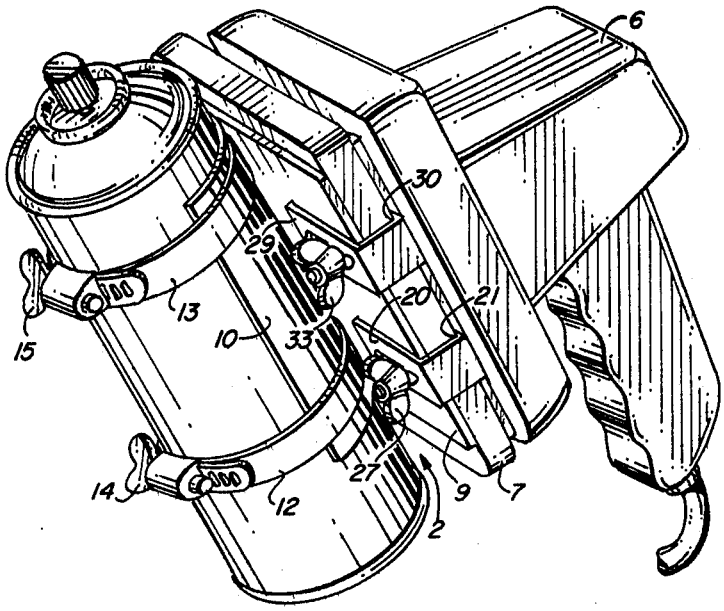
FIG. 1 is a perspective view of an apparatus for shaking a paint container utilized in conjunction with a hand-held power sander.
Figure 2:
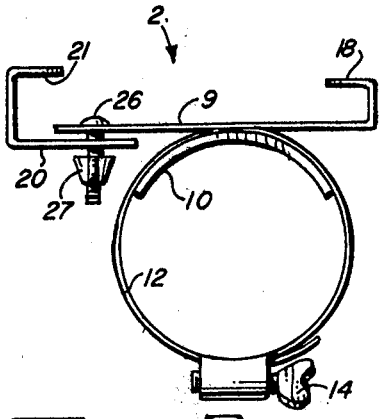
FIG. 2 is a back view of the shaking apparatus shown in FIG. 1.
Figure 3:
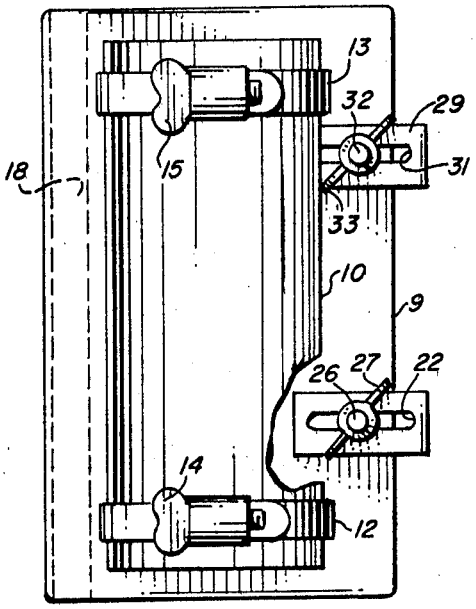
FIG. 3 is a bottom view of the shaking apparatus shown in FIG. 1.
Figure 4:
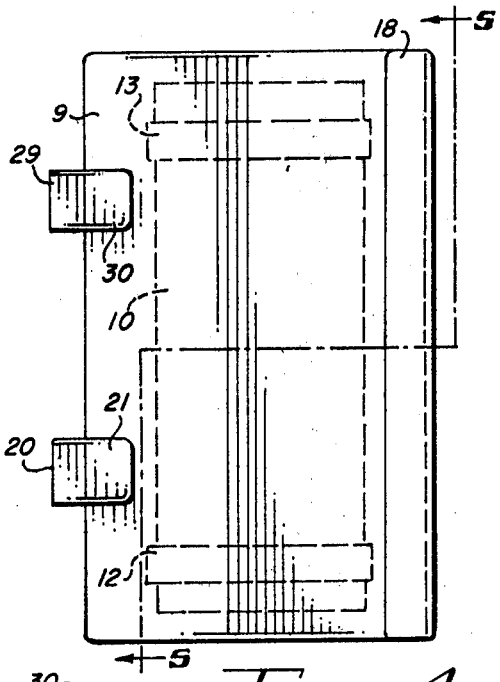
FIG. 4 is a top view of the shaking apparatus shown in FIG. 1.
Figure 5:
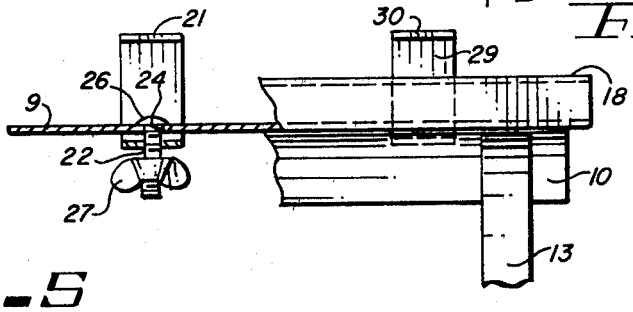
FIG. 5 is a cross-sectional side view taken through dashed lines 5—5 as shown in FIG. 4.

In FIG. 1, a shaking apparatus, designated generally by reference numeral 2, is shown for shaking an aerosol spray paint container 4. Shaking apparatus 2 is utilized in conjunction with an electric powered hand-held sander 6 and is secured to the vibrating sanding plate 7 thereof. Sander 4 may be either of the type which vibrates in a straight-line fashion or of the type which vibrates in an orbital fashion. Vibrating sanders of the types now commercially available typically vibrate at a frequency between 4,000 and 12,000 cycles or orbits per minute and are therefore well adapted for rapidly shaking paint container 4 when utilized in conjunction with the shaking apparatus described herein.

Referring to FIGS. 1–5, shaking apparatus 2 includes a base 9 having a curved cradle or saddle 10 attached thereto for receiving paint container 4. Adjustable band clamps 12 and 13 extend around cradle 10 at opposite ends thereof for removably clamping paint container 4 within cradle 10. Band clamps 12 and 13 are provided with thumbscrews 14 and 15, respectively, for either tightening or loosening band clamps 12 and 13. Those skilled in the art will realize that other types of clamping mechanisms may also be utilized to retain paint container 4 against cradle 10. For example, band clamps utilizing a snap-type clasp (described in further detail below with reference to FIG. 7) may be used in place of band clamps 12 and 13.

Base 9 includes a lipped edge portion 18 for extending over and engaging a first edge of vibrating sanding plate 7. A first clamping member 20 having a lipped edge portion 21 is attached to base 9 opposite lipped portion 18 thereof. A slot 22 is provided in first clamping member 20, and a hole 24 (see FIG. 5) is provided within base 9 adjacent first clamping member 20. A bolt 26 is extended through hole 24 and through slot 22, and a wing nut 27 is threaded over the end of bolt 26 for fastening first clamping member 20 in a predetermined position relative to base 9. Similarly, a second clamping member 29 having a lipped edge portion 30 is attached to base 9 opposite the lipped edge portion 18 thereof. A slot 31 is formed in second clamping member 29, and a hole (not shown) is formed within base 9 adjacent second clamping member 29. Bolt 32 and wing nut 33 serve to fasten second clamping member 29 in a predetermined position with respect to base 9.

The width of vibrating sanding plate 7 for conventional power sanders typically falls within the range of three and one-half inches to four and one-half inches. Accordingly, slots 22 and 31 within first and second clamping members 20 and 29, respectively, each exceed one inch in length to allow for sufficient variation in the distance between lipped edge portion 18 of base 9 and the lipped edge portions 21 and 30 for releasably securing base 9 to any of the various types of power sanders commercially available.

The vibrating sanding plate for the majority of power sanders presently available is eight inches or greater in length. However, some power sanders presently available, for example the power sander sold by Rockwell International Corporation under the registered trademark "SPEEDBLOC", have vibrating sanding plates as small as four inches in length. Accordingly, first and second clamping members 20 and 29 are preferably spaced approximately four inches apart for enabling the shaking apparatus to be utilized in conjunction with virtually all power sanders presently available.

During actual operation, the shaking apparatus illustrated in FIG. 1–5 is clamped to the vibrating sanding plate 7 of sander 6 by inserting lipped edge portion 18 of base 9 over one edge of vibrating sanding plate 7 and inserting lipped edge portions 21 and 30 of first and second clamping member 20 and 29, respectively, over the opposite edge of vibrating sanding plate 7. Wing nuts 27 and 33 are tightened for securing base 9 to vibrating sanding plate 7. Thumbscrews 14 and 15 are rotated for expanding band clamps 12 and 3, and paint container 4 is then inserted within cradle 10. Thumbscrews 14 and 15 are then rotated to tighten band clamps 12 and 13 for securing paint container 4 within cradle 10. Power sander 6 is then operated for several minutes to vigorously vibrate paint container 4 in order to return all settled paint pigment back into suspension.

Figure 6:
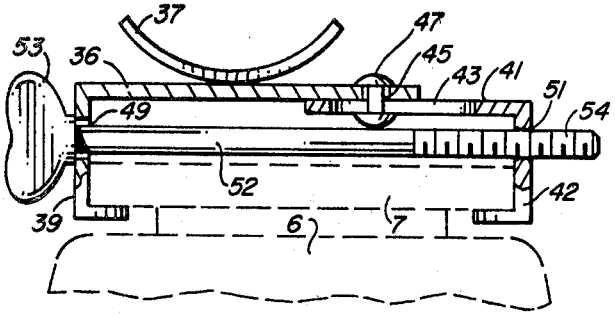
FIG. 6 is a cross-sectional view illustrating an alternative arrangement for clamping the shaking apparatus to the vibrating sanding plate of a hand-held power sander.

In FIG. 6, an alternate securing mechanism is illustrated for releasably securing base 9 of the shaking apparatus to vibrating sanding plate 7. Base 36 again includes a cradle 37 for receiving the paint container, and suitable band clamps (not shown) are also provided. Base 36 includes a lipped edge portion for engaging a first edge of vibrating sanding plate 7. A clamping member 41 is slidingly engaged with base 36 and includes a lipped edge portion 41 for engaging the opposite edge of vibrating sanding plate 7. A slot 43 is provided within clamping member 41, and a hole 45 is formed within base 36 adjacent clamping member 41. A rivet or pin 47 is inserted within slot 43 and hole 45 for slidingly engaging clamping member 41 with base 36.

To facilitate adjustment of the distance between opposing lipped edge portions 39 and 42, a hole 49 is formed within lipped edge portion 39 of base 36, and a threaded hole 51 is formed in lipped edge portion 42 of clamping member 41 opposite hole 49. A bolt 52 having a thumbscrew-type head 53 is inserted through hole 49 and includes a threaded end portion 54 for engaging threaded hole 51. As bolt 52 is turned, lipped edge portion 42 of clamping member 41 is urged toward lipped edged portion 39 of base 36 for securely clamping base 36 onto vibrating sanding plate 7. Holes 45 and 49 are disposed sufficiently far from the inwardly turned flanges of lipped edge portions 39 and 42, respectively, to allow vibrating sanding plate 7 of sander 6 to be completely inserted within the securing mechanism, the shaft of bolt 52 lightly contacting the foam padding typically attached to vibrating sanding plate 7.

The securing mechanisms illustrated in FIGS. 1–5 and in FIG. 6 for releasably securing the shaking apparatus to the vibrating sanding plate enable the shaking apparatus to be utilized in conjunction with virtually all power sanders presently available. However, it will be obvious to those skilled in the art that manufacturers of such power sanders could provide a plurality of threaded holes within the vibrating sanding plate. In this case, a corresponding plurality of holes could be provided within the base of the shaking apparatus. The base of the shaking apparatus could then be releasably secured to the vibrating sanding plate merely by inserting screws within each of the plurality of holes formed within the base and threading the plurality of screws into the corresponding plurality of threaded holes provided in the vibrating sanding plate.

Figure 7:
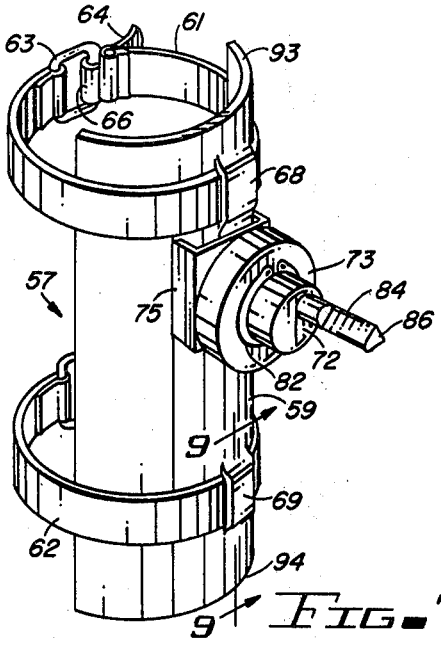
FIG. 7 is a perspective view of a shaking apparatus utilized in conjunction with a drill or other hand-held power tool having a rotatable chuck.
Figure 11:
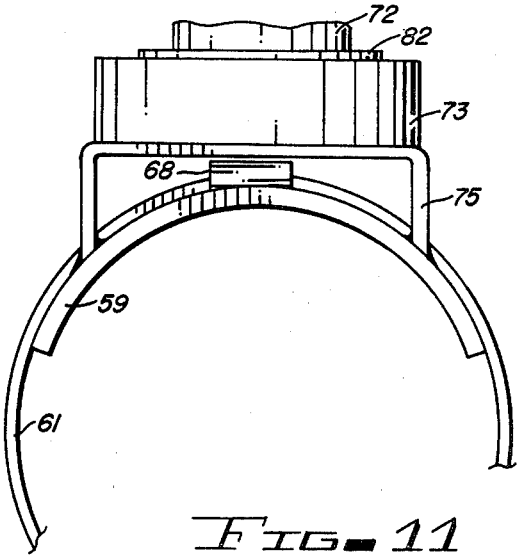
FIG. 11 is a cross-sectional view of the shaking apparatus taken through lines 11—11 as shown in FIG. 8.
Figure 8:
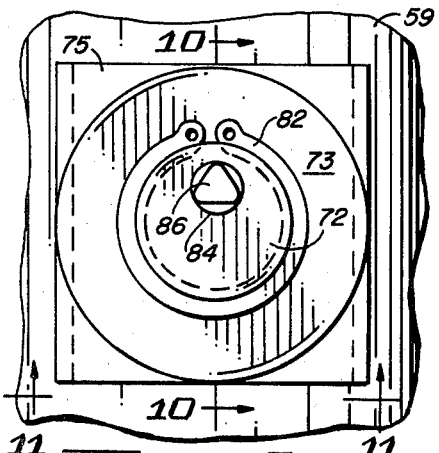
FIG. 8 is an enlarged partial view of the shaking apparatus shown in FIG. 7 and illustrates the means by which the rotational motion of the chuck is converted to oscillatory vibrational movement.

In FIG. 7, a shaking apparatus, designated generally by reference numeral 57, is shown which may be utilized in conjunction with a hand-held power tool having a rotatable chuck such as an electric or pneumatic powered drill. Shaking apparatus 57 includes a base 59 in the form of a cradle or saddle for receiving a paint container to be shaken. A pair of band clamps 61 and 62 are attached to base 59 for removably securing the paint container therein. Each of the band clamps is provided with a buckle 63 at one end of the band and a snap-type clasp 64 pivotally connected to the other end of the band. Clasp 64 includes a hooked end 66 at one end thereof for engaging buckle 63. As the end of clasp 64 opposite hooked end 66 is advanced toward buckle 63, band 61 is tightened for securing the paint container against base 59.

Figure 9:
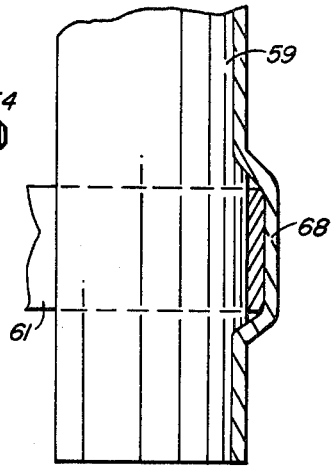
FIG. 9 is a cross-sectional view taken through lines 9—9 as shown in FIG. 7 and illustrates the manner in which a pair of clamps may be secured to a cradle for removably securing a container therein.

As shown best in FIG. 9, band clamps 61 and 62 may be attached to base 59 by punching portions 68 and 69 of base 59 and inserting bands 61 and 62 through the punched out portions 68 and 69, respectively. Those skilled in the art will appreciate that other clamping mechanisms, such as adjustable band clamps 12 and 13 described above with respect to FIG. 1, may be substituted for band clamps 61 and 62.

Referring to FIGS. 7, 8, 10 and 11, a first drive shaft 72 is shown rotatably mounted within bearing housing 73 which is, in turn, secured to base 59 by bracket 75. As shown best in FIG. 10, bearing housing 73 includes a bearing surface 77 for supporting first drive shaft 72. Bearing surface 77 may be a bronze bushing or bearing of the type impregnated with a lubricant and commercially available under the trademark "OILLITE". Alternatively, bearing surface 77 may consist of a series of roller bearings or other low friction members. First drive shaft 72 includes an enlarged rim 79 proximate the rear face thereof for retaining first drive shaft 72 within bearing housing 73. An annular slot 81 is formed within first drive shaft 72 proximate to the front face of bearing housing 72, and a spring steel circular clip 82 is inserted within annular slot 81 for restricting axial movement of first drive shaft 72.

A second drive shaft 84 has a first end secured to the front face of first drive shaft 72. The opposite end of first drive shaft 84 has a triangularly-shaped chamfered portion 86 for engaging the rotatable chuck 88 of a drill or other hand-held power tool. Preferably, second drive shaft 84 has a diameter of approximately one-quarter inch in order to be compatible with the popular, relatively inexpensive hand-held drills having a one-quarter inch drive chuck.

Figure 10:
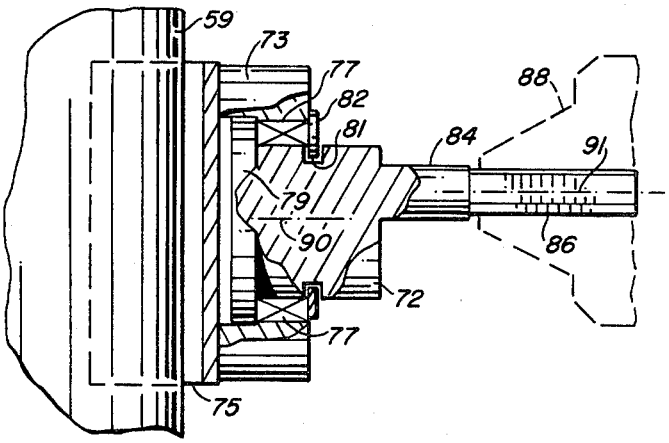
FIG. 10 is a cross-sectional view taken through lines 10—10 as shown in FIG. 8.

As shown in FIG. 10, first drive shaft 72 has an axis of rotation 90, and second drive shaft 84 has an axis of rotation 91 offset from axis 90. Thus, second drive shaft 84 is eccentrically coupled to first drive shaft 74 for causing base 59 to oscillate and vibrate when chuck 88 is rotated. The offset between axis 90 and axis 91 is preferably within the range of one-quarter inch to one-half inch. For power tools which can rotate chuck 88 at a relatively high rate of speed, the offset can be smaller than in the case of power tools which can rotate chuck 88 at a relatively low rate of speed.

In actual use of shaking apparatus 57, a paint container is inserted within base 59, and band clamps 61 and 62 are tightened for securing the container therein. Chamfered portion 86 of second drive shaft 84 is then inserted within rotatable chuck 88, and the chuck is tightened. The user then loosely holds one end of base 59 with one hand and operates the drill with the other hand in order to vigorously vibrate base 59 and the paint container secured thereto. In order that the user may more easily grasp base 59 as it is being vibrated, bracket 75 is located more closely to top edge 93 of base 59 than to the bottom edge 94. Preferably, bracket 75 is centered at a distance from top edge 93 of from one-third to one-fourth the total distance between top edge 93 and bottom edge 94. The user may then grasp base 59 near bottom edge 94 to more easily hold the shaking apparatus as it is being vibrated.

Figure 12:
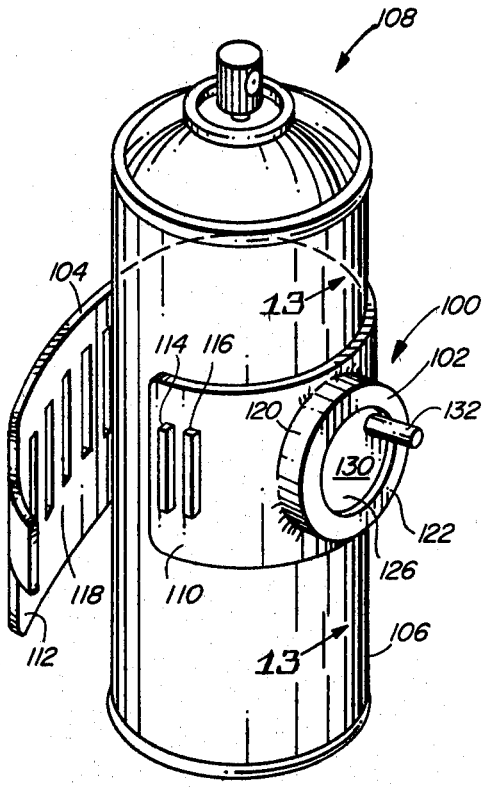
FIG. 12 is a perspective view of an apparatus for shaking a spray paint container according to an alternate embodiment of the present invention and illustrates the manner in which a band is used to secure a base member to the cylindrical side wall of the spray paint container.

Referring to FIG. 12, an alternate embodiment of an apparatus utilized in conjunction with a hand-held power drill for shaking a spray paint container is shown. The spray paint container shaking apparatus shown in FIG. 12, designated generally by reference numeral 100, includes a base member 102 in the form of a cylindrical housing and a band 104 secured to the rear portion of housing 102. Band 104 is adapted to encircle the central portion of the cylindrical side wall 106 of spray paint container 108. Band 104 has a first end 110 and a second end 112 which are adapted to be fastened to one another for releasably securing band 104 in a tightened position about the encircled portion of cylindrical side wall 106. The particular fastening mechanism illustrated within FIG. 12 includes a pair of elongated rectangular protrusions or tabs 114 and 116 extending outwardly from the outer face of band 104 proximate end 110 and a plurality of correspondingly sized apertures or slots, designated generally by reference numeral 118 formed within opposing end 112 of band 104. The plurality of slots 118 are spaced apart from one another by the same distance that tabs 114 and 116 are spaced apart from one another.

When securing shaking apparatus 100 to spray paint container 108, the user grasps housing 102 and pulls end 112 of band 104 until the band is tightened and then forces end 112 over end 110 to engage tabs 114 and 116 with two corresponding slots 118 to maintain band 104 in a tightened condition. Preferably, band 104 is somewhat elastic to allow the same to be stretched somewhat before ends 110 and 112 are fastened together. While the fastening mechanism specifically illustrated within FIG. 12 is comprised by tabs 114 and 116 and slots 118, those skilled in the art will appreciate that other fastening mechanisms, such as the over-center, snap-type clasps 64 described with reference to FIG. 7, may be used to fasten ends 110 and 112 of band 104 to one another to releasably secure band 104 in a tightened position about spray paint container 108.

Figure 13:
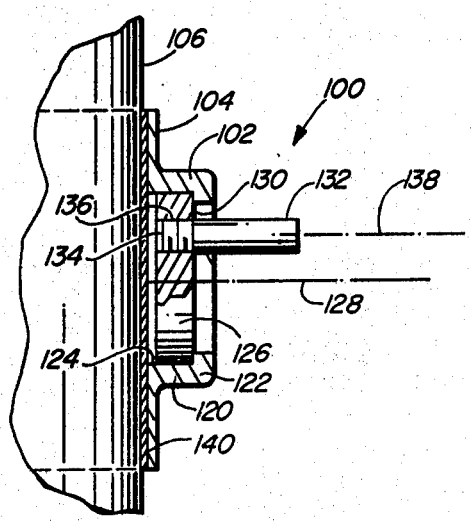
FIG. 13 is a cross-sectional view of the base member portion of the apparatus shown in FIG. 12 taken through lines 13—13 indicated within FIG. 12.

With reference jointly to FIGS. 12 and 13, housing 102 includes a cylindrical wall 120 terminating in a circular, inwardly turned flange 122. The inner surface 124 of cylindrical wall 120 defines a central bore within housing 102 which extends substantially perpendicular to the longitudinal axis of spray paint container 108. A first cylindrical drive shaft 126 is disposed within the central bore of housing 102 and has a diameter commensurate with that of inner surface 124 of cylindrical wall 120. Driveshaft 126 is free to rotate within the central bore of housing 102 about a first axis of rotation, designated by reference numeral 128, extending substantially perpendicular to the longitudinal axis of spray paint container 108. Driveshaft 126 includes a substantially planar front face 130 at an end thereof furthest from spray paint container 108 and extending substantially perpendicular to first axis of rotation 128. Front face 130 of driveshaft 126 is engaged by inwardly turned circular flange 122 for preventing the same from exiting housing 102 during operation of paint shaking apparatus 100.

Still referring to FIGS. 12 and 13, paint shaking apparatus 100 includes a second generally cylindrical driveshaft 132 secured at a first end thereof to driveshaft 126 and extending outwardly from front face 130 thereof by a distance commensurate with the length of the rotatable chuck (reference numeral 88 within FIG. 10) of a conventional hand-held power drill. As shown in FIG. 13, first end 134 of driveshaft 132 may be threaded for engaging a threaded bore 136 formed within driveshaft 126. The diameter of driveshaft 132 is smaller than the diameter of driveshaft 126 and extends along a second axis of rotation, designated by reference numeral 138, which is offset from but parallel to first axis of rotation 128. The exposed end of driveshaft 132 extending outwardly from front face 130 of driveshaft 126 is adapted to be engaged by the rotatable chuck of a hand-held power drill, and operation of the drill causes driveshaft 132 to rotate, in turn causing housing 102, and spray paint container 108 secured thereto, to vibrate due to the offset between axis of rotation 138 and axis of rotation 128. During such operation, the user loosely holds one end of spray paint container 108 in one of his hands while operating the trigger of the power drill with his other hand. In this manner, the operator may use paint shaking apparatus 100 without the necessity for mounting the device to a work bench; hence, paint shaking apparatus 100 is highly portable. In addition, paint shaking apparatus 100 is highly compact and may easily be stored within a small tool box or work bench drawer when not in use.

Paint shaking apparatus 100, as illustrated in FIGS. 12 and 13, may be constructed largely, or even entirely, from plastic materials and may thereby be manufactured for relatively little cost. Band 104 is preferably formed of a somewhat elastic plastic material. Housing 102 and driveshaft 126 are preferably formed of a rigid plastic material, such as nylon, to form a relatively inexpensive bearing between cylindrical inner surface 124 of housing 102 and the cylindrical side wall of driveshaft 126. Driveshaft 132 may also be made of nylon and formed integrally with driveshaft 126. Alternatively, driveshaft 132 may be made of metal, and first end 134 thereof may either threadedly engage driveshaft 126 or may be knurled for allowing driveshaft 126 to be molded therein, thereby embedding end 134 of driveshaft 132 within driveshaft 126. Shaking apparatus 100 is easily assembled by inserting driveshaft 126 into housing 102 through the rear portion thereof and subsequently adhesively bonding a thin sheet of foam 140 (see FIG. 13) upon the inner face of band 104 covering the central bore within housing 102. Foam sheet 140 prevents driveshaft 126 from exiting housing 102 when paint shaking apparatus 100 is not in use and facilitates the formation of a better grip between band 104 and paint container 108.

Figure 14:
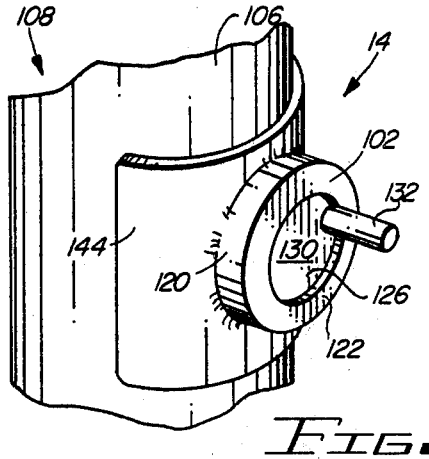
FIG. 14 is a partial perspective view of a disposable version of the shaking apparatus shown in FIG. 12 wherein the base member is permanently secured to the cylindrical side wall of the spray paint container as by welds or by adhesive bonding.

FIG. 14 illustrates an alternate embodiment of the present invention wherein components corresponding to those shown in FIGS. 12 and 13 are labeled with corresponding reference numerals. The shaking apparatus shown in FIG. 14, designated generally by reference numeral 142, however, differs from shaking apparatus 100 in the manner by which it is secured to cylindrical side wall 106 of spray paint container 108. Rather than using an encircling band such as band 104, the base member or housing 102 of paint shaking apparatus 142 is coupled to the outer face of a curved saddle member 144, the inner face of which forms a curved surface conforming to the contour of cylindrical side wall 106 of spray paint container 108. Saddle member 144 is then permanently secured to cylindrical side wall 106 by the manufacturer of spray paint container 108. Saddle member 144, or portions thereof, may be made of metal to allow the same to be welded to cylindrical side wall 106; alternatively, saddle member 144 may be adhesively bonded to cylindrical side wall 106. In either case, cans of spray paint may be sold at retail outlets with shaking apparatus 142 already attached without significantly increasing the cost for such products. Paint shaking apparatus 142 would be discarded along with spray paint container 108 when the contents thereof have been exhausted.

Figure 15:
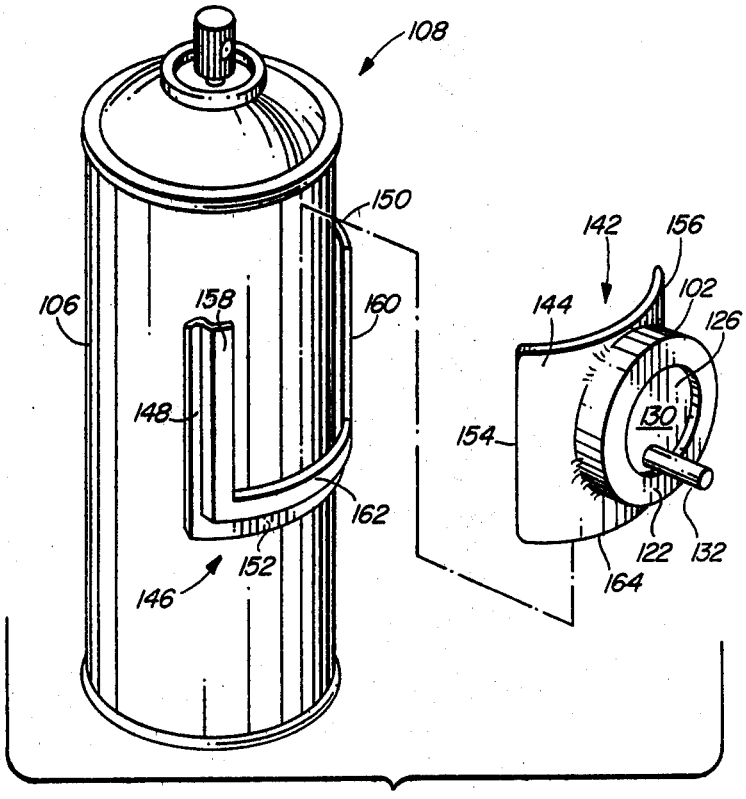
FIG. 15 is a perspective view of a shaking apparatus wherein a bracket is permanently affixed to the spray paint container and includes a channel for slidingly receiving the base member of the shaking apparatus.
Figure 16:
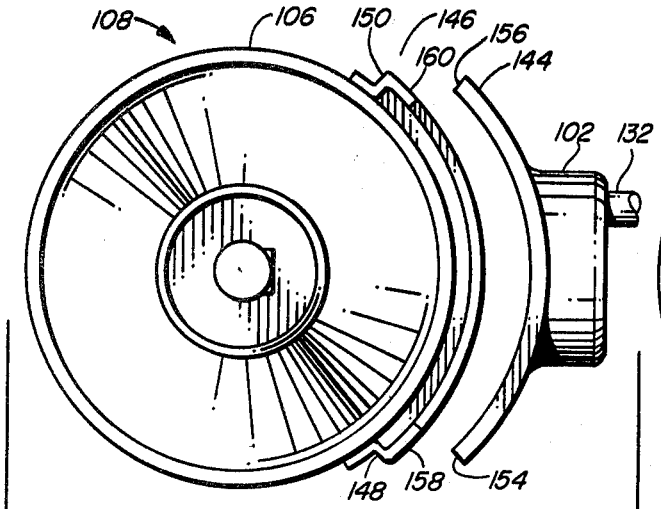
FIGS. 16 and 17 are top views of the spray paint container, affixed bracket, and shaking apparatus before and after, respectively, the base member of the shaking apparatus is slidingly engaged with its mating bracket.
Figure 17:
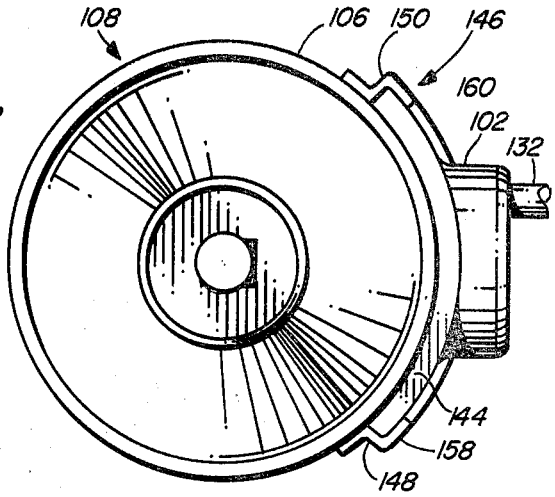

FIGS. 15–17 illustrate another manner in which paint shaking apparatus 142, shown in FIG. 14, can be secured to the cylindrical side wall 106 of spray paint container 108. As shown in FIGS. 15–17, a mounting bracket, designated generally by reference numeral 146, is permanently bonded to cylindrical side wall 106 of spray paint container 108 by the manufacturer of the container such as by welding or adhesive bonding. Mounting bracket 146 provides a channel, described in greater detail below, for slidingly receiving saddle member 144 of shaking apparatus 142 in order to releasably secure housing 102 to the cylindrical side wall 106 of spray paint container 108.

As shown in FIGS. 15–17, mounting bracket 146 includes first and second vertically extending, opposing portions 148 and 150, as well as a horizontal portion 152 extending between the lower ends of portions 148 and 150. Bracket portions 148 and 150 are spaced apart from one another by a distance commensurate with the distance between opposing side edges 154 and 156 of curved saddle member 144. Bracket portions 148 and 150 include flanges 158 and 160, respectively, which extend generally parallel to the portions of cylindrical side wall 106 proximate thereto. In addition, flanges 158 and 160 are spaced apart from cylindrical side wall 106 by a distance commensurate with the thickness of saddle member 144, or if saddle member 144 is not of uniform thickness, then commensurate with the thickness of saddle member 144 adjacent side edges 154 and 156 thereof. Bottom bracket portion 152 may also include a flange 162 for overlying bottom edge 164 of saddle member 144. Flanges 158, 160, and 162 provide a channel for slidingly receiving shaking apparatus 142 and securing the same to spray paint container 108.

As mentioned above, mounting bracket 146 may be affixed to spray paint container 108 by the manufacturer thereof. Shaking apparatus 142 may then be made separately available for purchase an a nominal price at retail outlets for such paint products.

Figure 18:
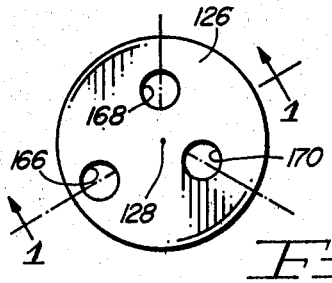
FIG. 18 is a front view of the first driveshaft of the shaking apparatus and illustrating the locations of a plurality of threaded bores formed therein for receiving the threaded end of the second driveshaft to adjust the degree of oscillation imparted to the spray paint container at predetermined rotational speeds of the power drill.
Figure 19:
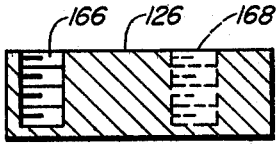
FIG. 19 is a cross-sectional view of the first driveshaft shown in FIG. 18 and taken through lines 19—19 indicated in FIG. 18.

Referring now to FIGS. 18 and 19, drive shaft 126 of either paint shaking apparatus 100 (FIGS. 12–13) or paint shaking apparatus 142 (FIGS. 14–17) is shown in an altered form whereby either paint shaking apparatus may be selectively adjusted to provide a desired amount of vibration of spray paint container 108 in spite of different operating speeds associated with various types of hand-held power drills. As shown in FIG. 18, driveshaft 126 is provided with three threaded bores 166, 168, and 170 disposed at varying distances from axis of rotation 128. Threaded bores 166, 168, and 170 each extend into drive shaft 126 from front face 130 thereof and are each adapted to receive threaded end 134 of second driveshaft 132. For those drills having relatively high fixed operating speeds, driveshaft 132 is engaged with threaded bore 170 for minimizing the offset between the axis of rotation 138 of driveshaft 132 (see FIG. 13) and axis of rotation 128 since the relatively high operating speed will cause sufficient vibration of the shaking apparatus. On the other hand, for those power drills having relatively low fixed operating speeds, driveshaft 132 is engaged with threaded bore 166 for maximizing the offset between axis of rotation 138 and axis of rotation 128 to sufficiently vibrate the shaking apparatus. For those drills having intermediate fixed operating speeds, driveshaft 132 is engaged with threaded bore 168 for selecting an intermediate degree of offset between axis of rotation 138 and axis of rotation 128.

Figure 20:
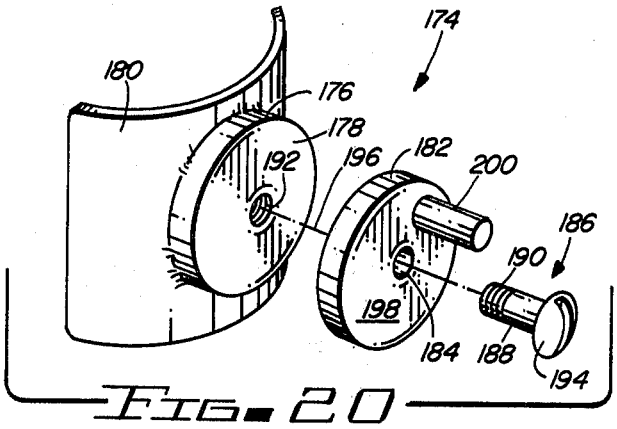
FIG. 20 is a perspective view of an alternate embodiment of the present invention wherein the base member includes a plate having a planar front face against which the first driveshaft is rotatably secured by a fastener extending through a bore formed within the first driveshaft.
Figure 21:
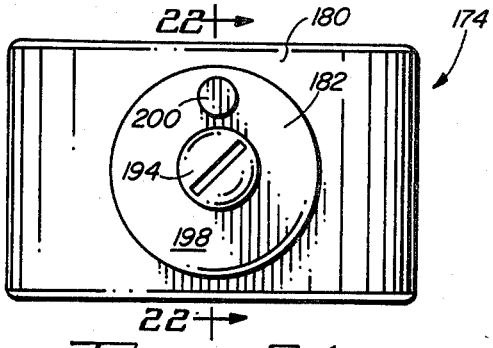
FIG. 21 is a front view of the shaking apparatus shown in FIG. 20.
Figure 22:
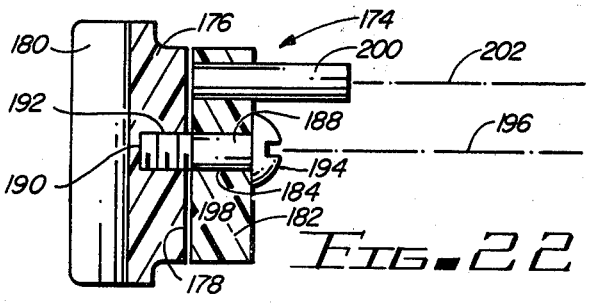
FIG. 22 is a cross-sectional view of the shaking apparatus shown in FIG. 21 taken through lines 22—22 indicated in FIG. 21.

FIGS. 20–22 illustrate another embodiment of an apparatus which may be utilized in conjunction with a hand-held power drill for shaking a spray paint container. The paint shaking apparatus, designated generally by reference numeral 174 includes a base member 176 in the form of a plate having a generally planar front face 178 extending substantially parallel to the longitudinal axis of the spray paint container to be shaken thereby. The rear portion of plate 176 is coupled to a curved backing surface, designated generally by reference numeral 180. Curved backing surface 180 may alternately represent a portion of band 104 shown in FIG. 12 or a saddle member such as that shown as 144 within FIGS. 14 and 15. In any event, curved backing surface 180 is intended to represent any of the various securing mechanisms previously described for securing plate 176 to the cylindrical side wall 106 of spray paint container 108.

Shaking apparatus 174 also includes a first drive shaft 182 having a smooth bore 184 formed in the central portion thereof and extending therethrough. Driveshaft 182 is retained adjacent front face 178 of plate 176 and is rotatably mounted thereto by a fastener such as bolt 186 which includes a smooth shaft portion 188 extending through smooth bore 184 of driveshaft 182. Bolt 186 has a first threaded end 190 engaged with a threaded bore 192 extending into plate 176 from front face 178 thereof. Bolt 186 also includes an enlarged head 194 at a second end thereof.

Bolt 186 rotatably mounts driveshaft 182 to plate 176 about a first axis of rotation designated by reference numeral 196 and extending substantially perpendicular to the longitudinal axis of the spray paint container being shaken. Driveshaft 182 includes a front face 198 opposite front face 178 of plate 176; front face 198 of driveshaft 182 extends substantially perpendicular to axis of rotation 196.

A second, generally cylindrical driveshaft 200 extends outwardly from front face 198 of cylindrical driveshaft 182 by a distance substantially commensurate with the length of the rotatable chuck (see 88 in FIG. 10) of a conventional hand-held power drill. The diameter of driveshaft 200 is smaller than the diameter of driveshaft 182, and driveshaft 200 is secured at a first end thereof to driveshaft 182 along a second axis of rotation, designated by reference numeral 202 offset from first axis of rotation 196 but substantially parallel thereto. The exposed second end of driveshaft 200 is engaged with the rotatable chuck of the hand-held power drill for rotating driveshaft 200 and thereby causing plate 176, and the spray paint container secured thereto, to vibrate due to the offset between axis of rotation 196 and axis of rotation 202. Once again, the user operates shaking apparatus 174 by operating the trigger of the power drill with one hand while loosely holding one end of the spray paint container in his other hand.

Shaking apparatus 174 shown in FIGS. 20–22 may be constructed relatively inexpensively by forming plate 176 and driveshaft 182 from a rigid plastic material, such as nylon, and by making bolt 186 out of metal to form an inexpensive but sufficiently sturdy bearing between the walls of smooth bore 184 within driveshaft 182 and the smooth shaft portion 188 of bolt 186. Driveshaft 200 may either be made of metal threaded into or embedded within driveshaft 182 or be made of plastic and formed integrally with driveshaft 182. In either case, paint shaking apparatus 174 may be made very inexpensively to form a compact and highly portable apparatus for shaking spray paint containers with the aid of a power drill.

Figure 23:
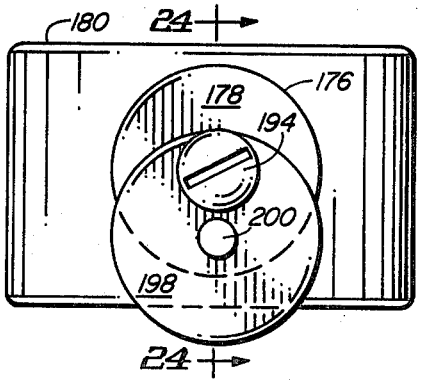
FIG. 23 is a front view of a shaking apparatus of the general type shown in FIG. 20 but wherein the first axis of rotation of the first driveshaft is offset from the center of the first driveshaft.
Figure 24:
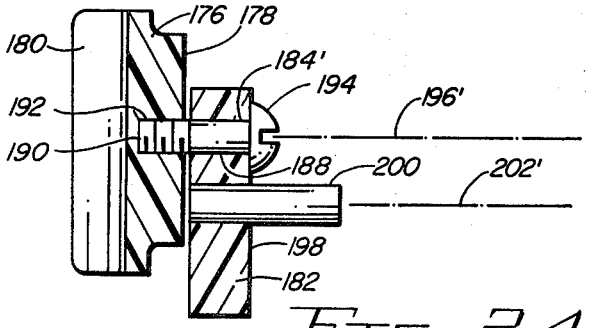
FIG. 24 is a cross-sectional view of the shaking apparatus shown in FIG. 23 taken through lines 24—24 indicated in FIG. 23.

FIGS. 23 and 24 illustrate a paint shaking apparatus similar to that shown in FIGS. 20–22, and corresponding components have been labeled with like reference numerals. The only difference between the paint shaking apparatus shown in FIGS. 23 and 24 and that shown in FIGS. 20–22 is that smooth bore 184' formed within driveshaft 182 is offset from the center of driveshaft 182 while driveshaft 200 extends generally into the center of driveshaft 182. Nonetheless, the offset between the axis of rotation 196' about which driveshaft 182 rotates and axis of rotation 202' about which driveshaft 200 rotates causes the identical vibratory motion of plate 176 when driveshaft 200 is rotated by a power drill.

Those skilled in the art will now appreciate that a highly portable, compact, and inexpensive apparatus has been described for conveniently shaking spray paint containers in conjunction with a conventional hand-held power drill. While the present invention has been described with reference to several preferred embodiments thereof, the description is for illustrative purposes only and is not to be construed as limiting the scope of the invention. Various modification and changes may be made by those skilled in the art without departing from the true spirit and scope of the invention as defined by the appended claims.

I claim:

1. An apparatus utilized in conjunction with a hand-held power drill for shaking a container of spray paint, the hand-held power drill including a rotatable chuck, the container of spray paint having a longitudinal axis and a cylindrical side wall, said apparatus comprising in combination:

a. a base member;

b. securing means for securing said base member to the cylindrical side wall of said spray paint container;

c. a first cylindrical driveshaft rotatably mounted to said base member for movement about a first axis of rotation extending substantially perpendicular to the longitudinal axis of said spray paint container, said first cylindrical driveshaft having a front face substantially perpendicular to said first axis of rotation at an end of said first cylindrical driveshaft furthest from said spray paint container;

d. a second generally cylindrical driveshaft extending outwardly from the front face of said first cylindrical driveshaft by a distance substantially commensurate with the length of the rotatable chuck of the hand-held power drill, said second generally cylindrical driveshaft having a diameter smaller than the diameter of said first cylindrical driveshaft, said second generally cylindrical driveshaft having a first end secured to said first cylindrical driveshaft and having a second end for being engaged by the rotatable chuck of the hand-held power drill, said second generally cylindrical driveshaft having a second axis of rotation extending substantially perpendicular to said front face of said first cylindrical driveshaft and substantially parallel to said first axis of rotation, said second axis of rotation being offset from said first axis of rotation for allowing a user to vibrate said base member and said spray paint container secured thereto by operating the hand-held power drill to rotate said second generally cylindrical driveshaft while holding said spray paint container loosely in one of the user's hands.

2. An apparatus as recited by claim 1 wherein said securing means comprises:

a. a band for encircling a portion of the cylindrical side wall of said spray paint container, said band being coupled to said base member; and b. fastening means for releasably securing said band in a tightened position about the encircled portion of the cylindrical side wall of said spray paint container.

3. An apparatus as recited by claim 2 wherein:

a. said band includes first and second opposing ends; and b. said fastening means comprises at least one aperture formed within said band proximate the first end thereof and at least one protrusion extending from said band proximate the second end thereof for engaging said aperture.

4. An apparatus as recited by claim 3 wherein at least a portion of said band is made of an elastic material for allowing said band to be stretched about the container of spray paint before said protrusion is engaged with said aperture.

5. An apparatus as recited by claim 1 wherein:

a. said base member includes a housing having a central bore therein, said central bore extending substantially perpendicular to the longitudinal axis of said spray paint container; and b. said first cylindrical driveshaft is disposed within the central bore of said housing for rotation therein.

6. An apparatus as recited by claim 5 wherein the central bore of said housing is bounded by a cylindrical inner wall of said housing, said first cylindrical driveshaft includes a cylindrical side wall, and wherein said housing and said first cylindrical driveshaft are each made of plastic to form a relatively inexpensive bearing between the cylindrical inner wall of said housing and the cylindrical side wall of said first cylindrical driveshaft.

7. An apparatus as recited by claim 6 wherein said second generally cylindrical driveshaft is made of metal, the first end of said second generally cylindrical driveshaft being embedded within said first cylindrical driveshaft.

8. An apparatus as recited by claim 7 wherein the first end of said second generally cylindrical driveshaft is threaded for threadedly engaging a threaded bore extending into said first cylindrical driveshaft from the front face thereof.

9. An apparatus as recited by claim 6 wherein said second generally cylindrical driveshaft is also made of plastic and is formed integrally with said first cylindrical driveshaft.

10. An apparatus as recited by claim 5 wherein:

a. said first cylindrical driveshaft has at least first and second threaded bores extending therein from the front face thereof, each of said first and second threaded bores extending perpendicular to the front face of said first cylindrical driveshaft, said first and second threaded bores being offset from said first axis of rotation by different amounts; and b. the first end of said second generally cylindrical driveshaft being threaded for alternately engaging either the first or second threaded bores within said first cylindrical driveshaft for selectively adjusting the extent to which the container of spray paint is vibrated when the rotatable chuck of the hand-held power drill is rotated at a predetermined rate.

11. An apparatus as recited by claim 1 wherein:

a. said base member comprises a plate having a generally planar front face extending substantially parallel to the longitudinal axis of said spray paint container;

b. said first cylindrical driveshaft has a smooth bore formed therein and extending therethrough along said first axis of rotation; and c. said apparatus further includes a fastener having a smooth shaft portion extending through the smooth bore of said first cylindrical driveshaft, said fastener having a first end fixedly engaged with said plate and a second end having an enlarged head overlying the front face of said first cylindrical driveshaft for retaining said first cylindrical driveshaft adjacent said plate.

12. An apparatus as recited by claim 11 wherein the smooth bore formed within said first cylindrical driveshaft is bounded by a cylindrical inner wall, and wherein said plate and said first cylindrical driveshaft are each made of plastic and said fastener is made of metal to form a relatively inexpensive bearing between the cylindrical inner wall of said first cylindrical driveshaft and the smooth shaft portion of said fastener.

13. An apparatus as recited by claim 12 wherein said second generally cylindrical driveshaft is also made of plastic and is formed integrally with said first cylindrical driveshaft.

14. An apparatus as recited by claim 1 wherein said securing means comprises a curved surface conforming to the contour of the cylindrical side wall of said spray paint container and adhesively bonded thereto, said curved surface supporting said base member.

15. An apparatus as recited by claim 1 wherein said securing means comprises a metal bracket for supporting said base member, said metal bracket being welded to the cylindrical side wall of said spray paint container.

16. An apparatus as recited by claim 1 wherein said securing means comprises a bracket permanently bonded to the cylindrical side wall of said spray paint container, said bracket providing a channel for slidingly receiving said base member to releasably secure said base member to the cylindrical side wall of said spray paint container.

17. An apparatus as recited by claim 16 wherein:

a. said channel is formed by first and second opposing portions of said bracket, said first and second opposing portions being spaced apart from one another by a first predetermined distance, each of said first and second opposing portions including a flange spaced apart from the cylindrical side wall of said spray paint container by a second predetermined distance, each such flange extending generally parallel to the portion of the cylindrical side wall of said spray paint container proximate thereto; and b. said base member includes a curved backing surface generally conforming to the contour of the cylindrical side wall of said spray paint container, said backing surface having first and second opposing side edges spaced apart from one another by an amount commensurate with said first predetermined distance, and said backing surface having a thickness adjacent said first and second opposing side edges commensurate with said second predetermined distance for allowing said backing surface to slide between said first and second opposing portions of said bracket behind each flange thereof.

* * * * *